US008262356B2

(12) United States Patent
Ammann

(10) Patent No.: US 8,262,356 B2
(45) Date of Patent: Sep. 11, 2012

(54) ROTOR CHAMBER COVER MEMBER HAVING APERTURE FOR DIRT SEPARATION AND RELATED TURBINE

(75) Inventor: Luke John Ammann, Simpsonville, SC (US)

(73) Assignee: General Electric Company, Schnectady, NY (US)

( * ) Notice: Subject to any disclaimer, the term of this patent is extended or adjusted under 35 U.S.C. 154(b) by 781 days.

(21) Appl. No.: 12/362,799

(22) Filed: Jan. 30, 2009

(65) Prior Publication Data

US 2010/0196167 A1 Aug. 5, 2010

(51) Int. Cl.
*F01D 5/18* (2006.01)

(52) U.S. Cl. ..... 416/97 R; 416/95; 415/115; 415/121.2

(58) Field of Classification Search ..... 415/115, 415/116, 95; 416/1, 97
See application file for complete search history.

(56) References Cited

U.S. PATENT DOCUMENTS

| | | | | |
|---|---|---|---|---|
| 3,918,835 | A * | 11/1975 | Yamarik et al. | 416/95 |
| 6,196,791 | B1 * | 3/2001 | Tomita et al. | 415/115 |
| 6,868,363 | B2 * | 3/2005 | Baran et al. | 702/158 |
| 7,137,777 | B2 * | 11/2006 | Fried et al. | 415/115 |
| 7,665,965 | B1 * | 2/2010 | Liang | 416/1 |
| 7,967,554 | B2 * | 6/2011 | Bremer | 415/121.2 |

* cited by examiner

*Primary Examiner* — Steven Loke
*Assistant Examiner* — David Goodwin
(74) *Attorney, Agent, or Firm* — Hoffman Warnick LLC; Ernest G. Cusick

(57) ABSTRACT

A cover member defining a rotor chamber adjacent to a rotor wheel that supports a rotating blade in a turbine includes a first aperture for introducing a cooling gas stream into the rotor chamber, and a second aperture positioned in a radially outward portion of the cover member for allowing a portion of the cooling gas stream to exit the rotor chamber. The portion of the cooling gas stream exiting the rotor chamber carries dirt particles to purge the rotor chamber.

13 Claims, 4 Drawing Sheets

ROTOR CHAMBER COVER MEMBER HAVING APERTURE FOR DIRT SEPARATION AND RELATED TURBINE

BACKGROUND OF THE INVENTION

The invention relates generally to turbine technology. More particularly, the invention relates to a cover member defining a rotor chamber in a turbine.

In turbines, gas or steam impinges on rotating blades that are coupled to a rotating shaft so as to cause the rotating shaft to turn. A cooling gas stream is directed through holes in the rotating blades to prevent overheating of the rotating blades. Ideally, the holes are as small as possible to increase cooling efficiencies. These smaller holes are more susceptible to being blocked by particles.

BRIEF DESCRIPTION OF THE INVENTION

A first aspect of the disclosure provides an apparatus comprising: a cover member defining a rotor chamber adjacent to a rotor wheel that supports a rotating blade in a turbine, the cover member including: a first aperture for introducing a cooling gas stream into the rotor chamber, and a second aperture positioned in a radially outward portion of the cover member for allowing a portion of the cooling gas stream to exit the rotor chamber.

A second aspect of the disclosure provides a turbine comprising: a plurality of rotating blades, each rotating blade coupled to a rotating shaft by a rotor wheel; and a cover member defining a rotor chamber adjacent to each rotor wheel, the cover member including: a first aperture for introducing a cooling gas stream into the rotor chamber, and a second aperture positioned in a radially outward portion of the cover member for allowing a portion of the cooling gas stream to exit the rotor chamber.

A third aspect of the disclosure provides a method comprising: introducing a cooling gas stream to a rotor chamber defined by a cover member adjacent to a rotor wheel that supports a rotating blade in a turbine; allowing a portion of the cooling gas stream to exit the rotor chamber through an aperture in a radially outward portion of the cover member; and directing a remainder of the cooling gas stream to cool the rotating blade.

DETAILED DESCRIPTION OF THE INVENTION

Figure 1:
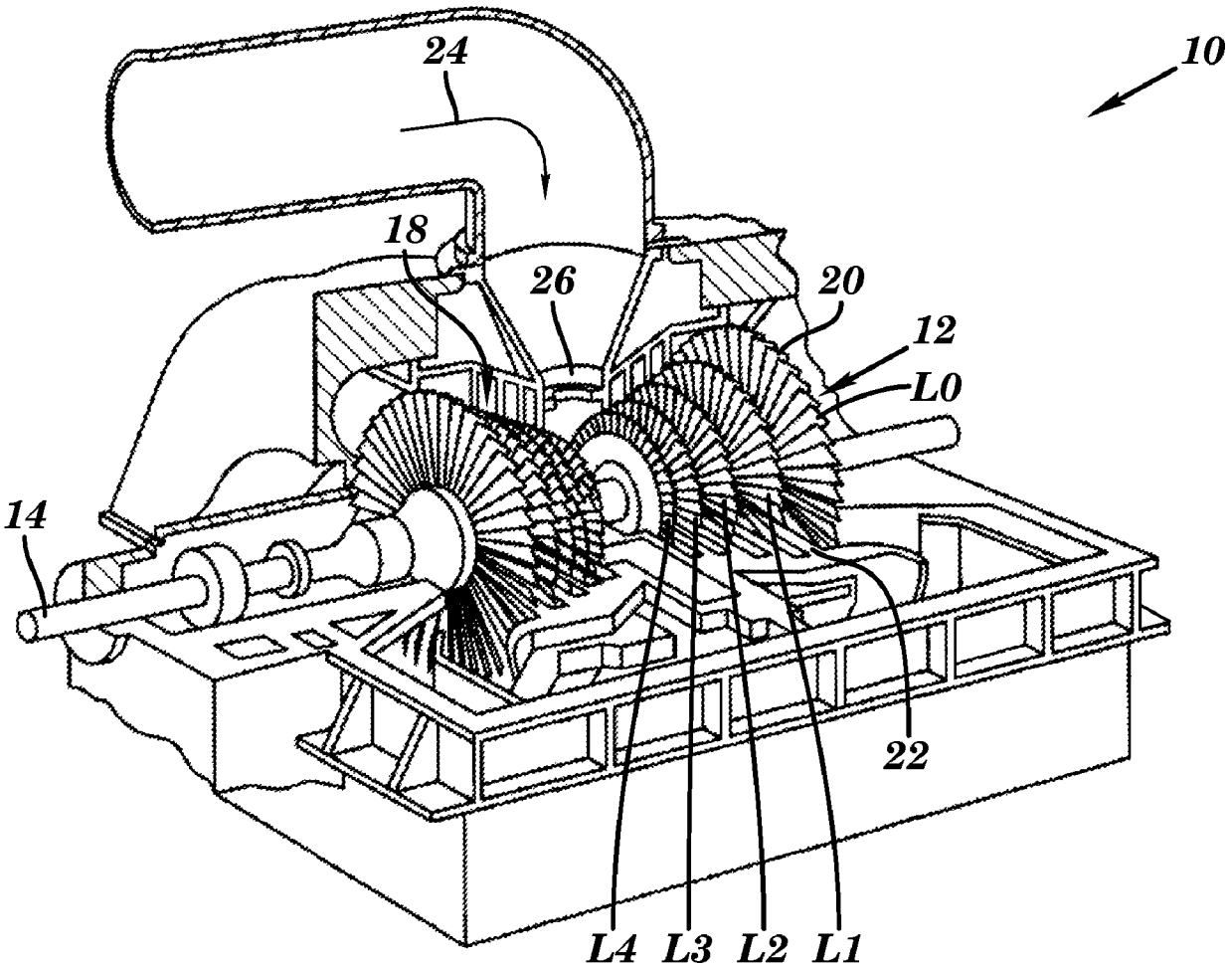
FIG. 1 shows a perspective partial cut-away illustration of a gas or steam turbine.

Referring to the drawings, FIG. 1 shows a perspective partial cut-away illustration of a gas or steam turbine 10. Turbine 10 includes a rotor 12 that includes a rotating shaft 14 and a plurality of axially spaced rotor wheels 18. A plurality of rotating blades 20 are mechanically coupled to each rotor wheel 18. More specifically, blades 20 are arranged in rows that extend circumferentially around each rotor wheel 18. A plurality of stationary vanes 22 extend circumferentially around shaft 14, and the vanes are axially positioned between adjacent rows of blades 20. Stationary vanes 22 cooperate with blades 20 to form a stage and to define a portion of a steam flow path through turbine 10.

In operation, gas or steam 24 enters an inlet 26 of turbine 10 and is channeled through stationary vanes 22. Vanes 22 direct gas or steam 24 downstream against blades 20. Gas or steam 24 passes through the remaining stages imparting a force on blades 20 causing shaft 14 to rotate. At least one end of turbine 10 may extend axially away from rotating shaft 12 and may be attached to a load or machinery (not shown) such as, but not limited to, a generator, and/or another turbine.

In one embodiment, turbine 10 may include five stages. The five stages are referred to as L0, L1, L2, L3 and L4. Stage L4 is the first stage and is the smallest (in a radial direction) of the five stages. Stage L3 is the second stage and is the next stage in an axial direction. Stage L2 is the third stage and is shown in the middle of the five stages. Stage L1 is the fourth and next-to-last stage. Stage L0 is the last stage and is the largest (in a radial direction). It is to be understood that five stages are shown as one example only, and each turbine may have more or less than five stages. Also, as will be described herein, the teachings of the invention do not require a multiple stage turbine.

Figure 2:
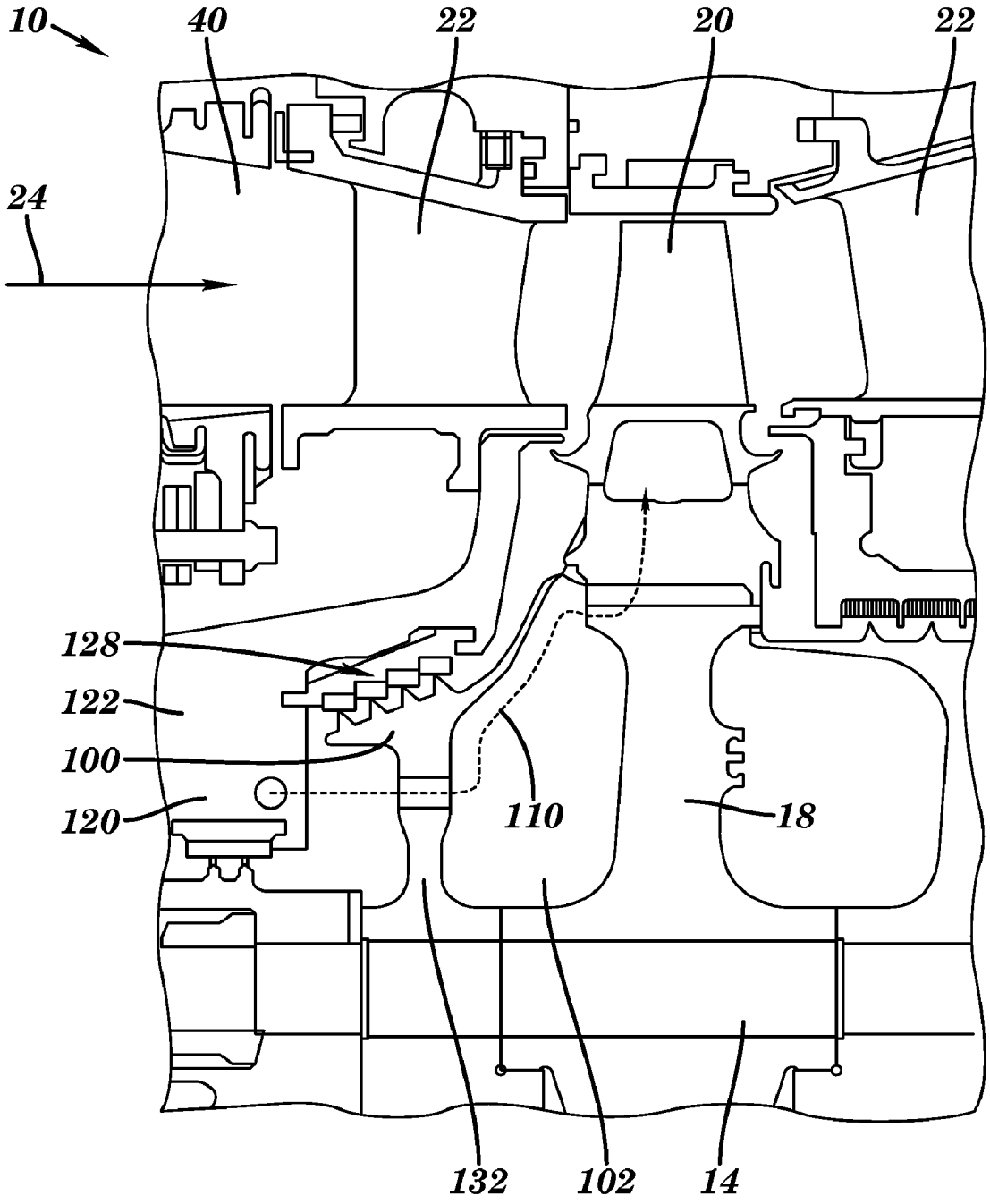
FIG. 2 shows a cross-sectional view of a stage of a turbine including a cover member according to one embodiment of the invention.

FIG. 2 shows a cross-sectional view of one stage of turbine 10. As noted above, each stage includes a plurality of rotating blades 20 (one shown) coupled to rotating shaft 14 via a rotor wheel 18. Gas or steam 24 flowing through a path 40 impinges on rotating blades 20 to turn rotating shaft 14. That is, rotating shaft 14 includes rotor wheels 18 that couple to and support rotating blades 20. A cover member 100 rotates with rotating shaft 14 and defines a rotor chamber 102 (or wheel space) adjacent to rotor wheel 18 that supports rotating blades 20 in turbine 10. Rotor chamber 102 is thus defined between rotor wheel 18 and cover member 100. Cover member 100 is sealed against rotor wheel 18 and/or rotating blade 20 at a radially outward portion thereof (140 in FIGS. 3-4).

A cooling gas stream 110 is directed through another path 120 in a support ring 122, which may be part of a nozzle or casing of the stage to which cover member 100 belongs. An outer extremity of cover member 100 may be sealed against support ring 122 by a seal 128, e.g., a labyrinth seal. Cooling gas stream 110 may be generated, for example, from a compressor (not shown) and may include, for example, air or other gases and dust.

Figure 3:
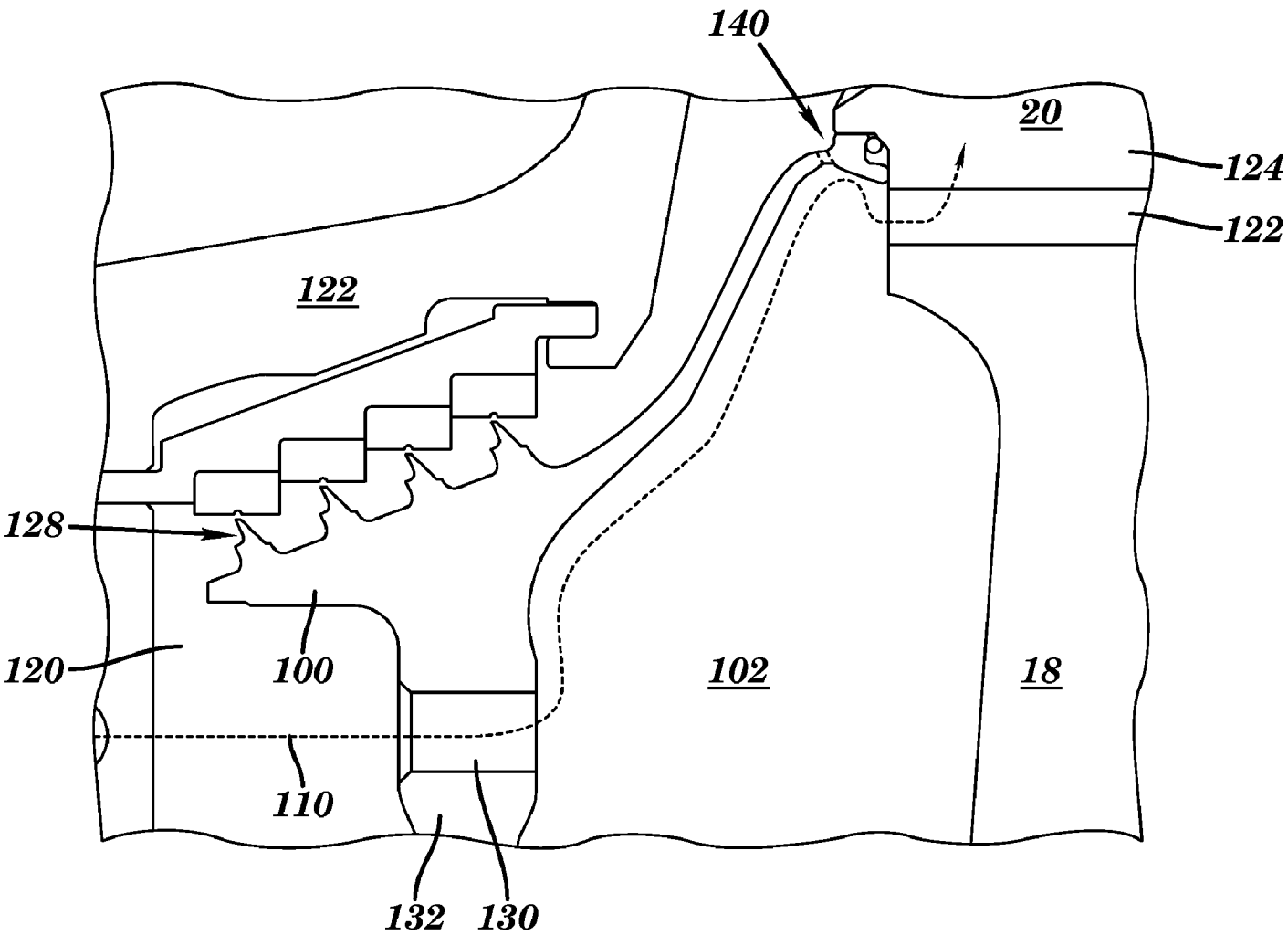
FIG. 3 shows an exploded cross-sectional view of the cover member of FIG. 1.

Referring to FIG. 3, cooling gas stream 110 passes through an aperture 130 in cover member 100 (or in a rotor arm 132 that supports cover member 100) to be introduced into rotor chamber 102 between cover member 100 and rotor wheel 18. Aperture 130 may force cooling gas stream 110 to rotate as it enters rotor chamber 102, e.g., by having a helical path. Typically, all of cooling gas stream 110 follows a path of cover member 100 and enters holes 122 in a base 124 of rotating blades 20. Cooling gas stream 110 cools rotating blades 20 and prevents overheating of the rotating blades. Holes 122 are presented circumferentially (into and out of page) about rotor wheel 18 where rotating blades 20 are coupled thereto. As understood in the art, once cooling gas stream 110 enters holes 122, it is directed radially outward towards an end of rotating blades 20 via passages (not shown) therein. As noted above, ideally, holes 122 are as small as possible to increase cooling efficiencies. Cooling gas stream 110 is also directed radially outward as it rotates within rotor chamber 102, which causes dirt particles therein to collect by centrifugal force on rotor wheel 18 of rotating shaft 14 and not enter holes 122.

Figure 4:
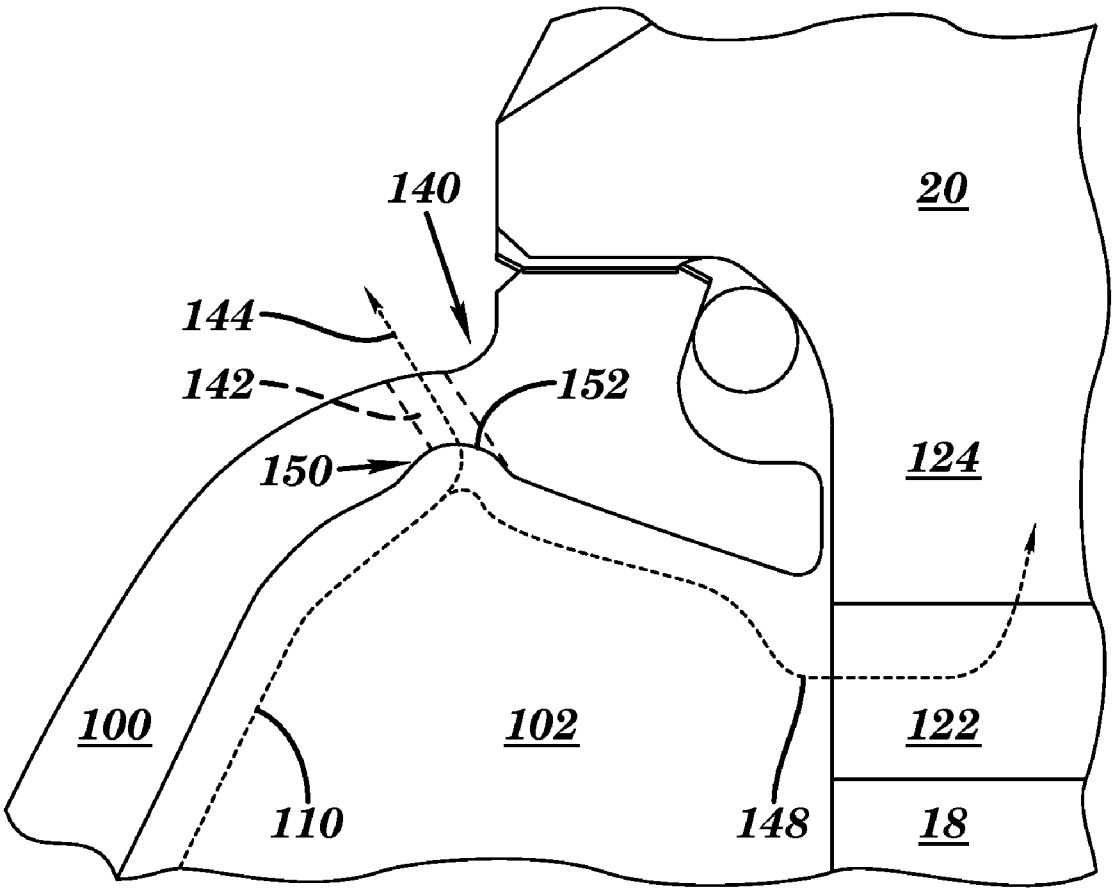
FIG. 4 shows an exploded cross-sectional view of a radially outward portion of the cover member of FIG. 1.

FIG. 4 shows an exploded cross-sectional view of a radially outward portion 140 of cover member 100. Radially outward portion 140 is some times referred to as a cover plate. As best shown in FIG. 4, in order to address the above-described dirt situation, according to one embodiment of the invention, a plurality of apertures 142 are positioned in radially outward portion 140 of cover member 100. While only one aperture 142 is shown, it is readily understood that more apertures 142 are provided along the circumference of cover member 100. Aperture 142 allows a portion 144 of cooling gas stream 110 to exit rotor chamber 102 and consequently purge the rotor chamber. Portion 144 of cooling gas stream 110 (which may include air and dirt particles) is used to purge the rotor chamber to prevent hot gas from ingesting into the rotor chamber. In particular, aperture 142 is sized so as to allow dirt particles to be carried by portion 144 and purged the rotor chamber, but direct a majority of cooling gas stream 110 along its normal path, i.e., into holes 122. In this fashion, cooling gas stream 110 cools rotating blades 20 as normal, while the air and dirt particles of portion 144 purge rotor chamber. Portion 144 also prevents hot gases or steam 24 (FIGS. 1-2) that may have escaped from gas or steam path 112 (FIG. 2) from entering rotor chamber 102. A remainder 148 of cooling gas stream 110 not exiting rotor chamber 102 enters holes 122 to perform the above-described rotating blade 20 cooling.

In an alternative embodiment, shown in FIG. 4, aperture 142 may be provided within and pass through a dirt trap 150. Dirt trap 150 may include a concavity 152 in radially outward portion 142 of cover member 100. That is, concavity 152 exists within the otherwise continuous inner surface of cover member 100. Although shown as a cupped-shaped concavity, it is emphasized that concavity 152 may take any form capable of collecting dirt particles therein prior to being directed through aperture 142, e.g., a squared off trench, a less semi-circular shaped concavity, etc.

While cover member 100 has been illustrated as a separate structure from rotor wheel 18 and rotating blade 20, it is understood that cover member 100 or a portion thereof including aperture 142 for dirt separation may be formed as part of rotating blade 20, rotor wheel 18 and/or other structure. For example, radially outward portion 140 of cover member 100 may be formed as an integral part of rotor wheel 18 rather than as part of a separate section 100 supported by arm 132. Seals would be provided to seal rotor wheel 18 with the remaining structure of cover member 100 and/or support ring 122, as necessary. Consequently, the term "cover member" should be given a broad interpretation within the scope of the invention as any feature defining rotor chamber 102 adjacent rotor wheel 18.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 wt %, or, more specifically, about 5 wt % to about 20 wt %", is inclusive of the endpoints and all intermediate values of the ranges of "about 5 wt % to about 25 wt %," etc).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus comprising:

a cover member defining a rotor chamber adjacent to a rotor wheel that supports a rotating blade in a turbine, the cover member including:

a first aperture for introducing a cooling gas stream into the rotor chamber, wherein the cover member partially defines a flow path for the cooling gas stream through the rotor chamber;

a second aperture positioned in a radially outward portion of the cover member relative to the first aperture, the second aperture adapted to allow a first portion of the cooling gas stream to exit the rotor chamber through the cover member, wherein the second aperture is further adapted to allow particulates in the cooling gas stream to exit the rotor chamber through the cover member; and a seal sealing an outer extremity of the cover member from the rotor chamber to a support ring of a casing of the turbine, the seal located radially inward of the second aperture.

2. The apparatus of claim 1, further comprising a plurality of apertures positioned in a radially outward portion of the cover member for allowing the first portion of the cooling gas stream to exit the rotor chamber through the cover member.

3. The apparatus of claim 1, further comprising a dirt trap in the radially outward portion of the cover member.

4. The apparatus of claim 1, wherein the second aperture is positioned radially outward relative to a set of holes in a rotor wheel.

5. The apparatus of claim 3, wherein the second aperture passes through the dirt trap.

6. The apparatus of claim 1, wherein the first aperture includes a helical path adapted to rotate the cooling gas stream.

7. The apparatus of claim 1, wherein the cover member is adapted to direct a second portion of the cooling gas stream through the rotor chamber and into a set of holes in the rotor wheel which extend substantially parallel to an axis of the rotating shaft.

8. A turbine comprising:

a plurality of rotating blades, each rotating blade coupled to a rotating shaft by a rotor wheel, wherein the rotor wheel includes a set of holes for introducing a first portion of a cooling gas stream into the plurality of rotating blades; and a cover member defining a rotor chamber adjacent to each rotor wheel and partially defining a flow path for the cooling gas stream through the rotor chamber, the cover member including:

a first aperture for introducing the cooling gas stream into the rotor chamber; and a second aperture positioned in a radially outward portion of the cover member relative to the first aperture, the second aperture adapted to allow a second portion of the cooling gas stream to exit the rotor chamber through the cover member, wherein the second aperture is positioned radially outward of the set of holes and is further adapted to allow particulates in the cooling gas stream to exit the rotor chamber through the cover member.

9. The turbine of claim 8, wherein the set of holes extend substantially parallel to an axis of the rotating shaft.

10. The turbine of claim 8, further comprising a seal sealing an outer extremity of the cover member from the rotor chamber to a support ring of a casing of the turbine, the seal located radially inward of the second aperture.

11. The turbine of claim 8, further comprising a dirt trap in the radially outward portion of the cover member.

12. The turbine of claim 11, wherein the second aperture passes through the dirt trap.

13. A turbine comprising:

a plurality of rotating blades, each rotating blade in the plurality of rotating blades coupled to a rotating shaft by a rotor wheel, wherein the rotor wheel includes a set of holes for introducing a first portion of a cooling gas stream into the plurality of rotating blades, the set of holes extending substantially parallel to an axis of the rotating shaft;

a cover member defining a rotor chamber adjacent to each rotor wheel and partially defining a flow path for the cooling gas stream through the rotor chamber, the cover member including:

a first aperture for introducing the cooling gas stream into the rotor chamber; and a second aperture positioned in a radially outward portion of the cover member relative to the first aperture, the second aperture adapted to allow a second portion of the cooling gas stream to exit the rotor chamber through the cover member, wherein the second aperture is further adapted to allow particulates in the cooling gas stream to exit the rotor chamber through the cover member; and a seal sealing an outer extremity of the cover member from the rotor chamber to a support ring of a casing of the turbine, the seal located radially inward of the second aperture.

* * * * *